US009312059B2

(12) United States Patent
Dinh et al.

(10) Patent No.: US 9,312,059 B2
(45) Date of Patent: Apr. 12, 2016

(54) INTEGRATED CONNECTOR MODULES FOR EXTENDING TRANSFORMER BANDWIDTH WITH MIXED-MODE COUPLING USING A SUBSTRATE INDUCTIVE DEVICE

(71) Applicant: Pulse Electronics, Inc., San Diego, CA (US)

(72) Inventors: Thuyen Dinh, San Diego, CA (US); Mohammad Saboori, San Diego, CA (US); Mark Greene, San Diego, CA (US); Hamlet Abedmamoore, San Diego, CA (US)

(73) Assignee: PULSE ELECTRONIC, INC., San Diego, CA (US)

( * ) Notice: Subject to any disclaimer, the term of this patent is extended or adjusted under 35 U.S.C. 154(b) by 0 days.

(21) Appl. No.: 14/057,900

(22) Filed: Oct. 18, 2013

(65) Prior Publication Data

US 2014/0127944 A1 May 8, 2014

Related U.S. Application Data

(60) Provisional application No. 61/723,688, filed on Nov. 7, 2012.

(51) Int. Cl.
*H01F 5/00* (2006.01)
*H01F 17/00* (2006.01)
(Continued)

(52) U.S. Cl.
CPC ..... *H01F 17/0033* (2013.01); *H01F 5/00* (2013.01); *H01F 17/06* (2013.01); *H01F 27/28* (2013.01);
(Continued)

(58) Field of Classification Search
CPC ..... H01F 5/00; H01F 27/00–27/30
USPC ..... 336/65, 83, 200, 232, 225, 229
See application file for complete search history.

(56) References Cited

U.S. PATENT DOCUMENTS 2,470,598 A 5/1949 Biebesheimer
3,419,835 A 12/1968 Stein
(Continued)

FOREIGN PATENT DOCUMENTS

CN 1270332 8/2006
CN 1993782 A 7/2007
(Continued)

OTHER PUBLICATIONS

An Overview of Rogowski Coil Current Sensing Technology; David E. Shepard, Tactical Marketing Manager and Donald W. Yauch Applications Manager; LEM DynAmp Inc.
(Continued)

*Primary Examiner* — Tuyen Nguyen
(74) *Attorney, Agent, or Firm* — Gazdzinski & Associates, PC

(57) ABSTRACT

An improved low cost and highly consistent inductive apparatus. In one embodiment, the low cost and highly consistent inductive apparatus addresses concerns with so called conductive anodic filament (CAF) that occurs within these laminate structures. These conditions include high humidity, high bias voltage (i.e. a large voltage differential), high-moisture content, surface and resin ionic impurities, glass to resin bond weakness and exposure to high assembly temperatures that can occur, for example, during lead free solder bonding application. In a variant, mixed mode coupling techniques are utilized in order to extend the underlying operating bandwidth of the substrate inductive device. Methods of manufacturing and using the aforementioned substrate inductive devices are also disclosed.

20 Claims, 6 Drawing Sheets

(51) Int. Cl.
*H01F 27/28* (2006.01)
*H01F 41/04* (2006.01)
*H01F 17/06* (2006.01)

(52) U.S. Cl.
CPC ..... *H01F 41/04* (2013.01); *H01F 41/046* (2013.01); *H01F 2017/002* (2013.01); *Y10T 29/4902* (2015.01)

(56) References Cited

U.S. PATENT DOCUMENTS 3,477,051 A 11/1969 Kendall et al.
3,605,055 A 9/1971 Grady
3,614,554 A 10/1971 Shield et al.
3,626,291 A 12/1971 Yauch et al.
3,699,488 A 10/1972 Goodman et al.
3,947,795 A 3/1976 Donnelly et al.
4,091,349 A 5/1978 Niederjohn et al.
4,103,268 A 7/1978 Anders et al.
4,146,860 A 3/1979 Miller
4,253,231 A 3/1981 Nouet
4,547,961 A 10/1985 Bokil et al.
4,616,176 A 10/1986 Mercure et al.
4,709,205 A 11/1987 Baurand et al.
4,777,381 A 10/1988 Fernandes
4,847,986 A 7/1989 Meinel
5,038,104 A 8/1991 Wikswo et al.
5,055,816 A 10/1991 Altman et al.
5,066,904 A 11/1991 Bullock
5,126,714 A 6/1992 Johnson
5,220,488 A 6/1993 Denes
5,257,000 A 10/1993 Billings et al.
5,299,956 A 4/1994 Brownell et al.
5,414,400 A 5/1995 Gris et al.
5,430,613 A 7/1995 Hastings et al.
5,442,280 A 8/1995 Baudart
5,451,914 A 9/1995 Stengel
5,487,214 A * 1/1996 Walters ..... 29/602.1
5,671,856 A 9/1997 Lisch
5,726,615 A 3/1998 Bloom
5,736,910 A * 4/1998 Townsend et al. ..... 333/181
5,781,091 A * 7/1998 Krone et al. ..... 336/200
5,959,846 A 9/1999 Noguchi et al.
5,982,265 A 11/1999 Von Skarczinski et al.
6,018,239 A 1/2000 Berkcan et al.
6,087,920 A 7/2000 Abramov
6,094,044 A 7/2000 Kustera et al.
6,148,500 A 11/2000 Krone et al.
6,193,560 B1 2/2001 Morana et al.
6,225,560 B1 5/2001 Machado
6,270,380 B1 8/2001 Shichida et al.
6,270,381 B1 8/2001 Adriaenssens et al.
6,313,623 B1 11/2001 Kojovic et al.
6,332,810 B1 12/2001 Bareel
6,409,547 B1 6/2002 Reede
6,414,475 B1 7/2002 Dames et al.
6,428,362 B1 8/2002 Phommachanh
6,440,750 B1 8/2002 Feygenson et al.
6,445,271 B1 9/2002 Johnson
6,455,885 B1 9/2002 Lin
6,464,541 B1 10/2002 Hashim et al.
6,545,456 B1 4/2003 Radosevich et al.
6,585,540 B2 7/2003 Gutierrez et al.
6,614,218 B1 9/2003 Ray
6,642,827 B1 11/2003 McWilliams
6,655,988 B1 12/2003 Simmons et al.
6,677,850 B2 1/2004 Dames
6,696,910 B2 * 2/2004 Nuytkens et al. ..... 336/200
6,731,193 B2 5/2004 Meier et al.
6,734,661 B2 5/2004 Colby et al.
6,769,166 B1 8/2004 Blanchard
6,769,936 B2 8/2004 Gutierrez et al.
6,822,547 B2 11/2004 Saito et al.
6,825,650 B1 11/2004 McCormack et al.
6,848,943 B2 2/2005 Machado et al.
6,926,558 B2 8/2005 Sasai et al.
6,952,153 B2 10/2005 Jacobson et al.
6,962,511 B2 11/2005 Gutierrez et al.
6,963,195 B1 11/2005 Berkcan
6,965,225 B2 11/2005 De Buda et al.
7,078,888 B2 7/2006 Budillon et al.
7,109,837 B2 9/2006 Watts
7,145,784 B2 12/2006 Utsuno et al.
7,158,005 B2 1/2007 Pleskach et al.
7,196,607 B2 * 3/2007 Pleskach et al. ..... 336/200
7,227,441 B2 6/2007 Skendzic et al.
7,227,442 B2 6/2007 Skendzic
7,241,181 B2 * 7/2007 Machado et al. ..... 439/676
7,253,603 B2 8/2007 Kovanko et al.
7,271,697 B2 9/2007 Whittaker et al.
7,277,002 B2 10/2007 Harding
7,322,863 B2 1/2008 Rapp
7,367,851 B2 5/2008 Machado et al.
7,405,643 B2 7/2008 Jeong et al.
7,408,434 B2 8/2008 Lee et al.
7,477,128 B2 1/2009 Quilici et al.
7,489,226 B1 2/2009 Chignola et al.
7,510,441 B2 * 3/2009 Zhang et al. ..... 439/620.18
7,524,206 B2 4/2009 Gutierrez et al.
7,538,541 B2 5/2009 Kojovic
7,564,233 B2 7/2009 Kojovic
7,598,837 B2 10/2009 Gilmartin et al.
7,598,839 B1 10/2009 Wedley
7,656,263 B2 2/2010 Whittaker et al.
7,661,994 B2 2/2010 Machado et al.
7,671,716 B2 3/2010 Chen
7,708,602 B2 5/2010 Rascon et al.
7,724,204 B2 5/2010 Annamaa et al.
7,819,699 B2 10/2010 Xu et al.
7,821,374 B2 10/2010 Harrison
7,868,727 B2 1/2011 Chen et al.
7,961,072 B2 6/2011 Pilniak et al.
7,982,572 B2 7/2011 Schaffer et al.
8,203,418 B2 6/2012 Harrison et al.
8,234,778 B2 8/2012 Schaffer et al.
8,319,628 B2 11/2012 Schweitzer, III et al.
2002/0158305 A1 10/2002 Dalmia et al.
2003/0011458 A1 1/2003 Nuytkens et al.
2003/0112000 A1 6/2003 Sorenson, Jr. et al.
2004/0000968 A1 1/2004 White et al.
2004/0005820 A1 1/2004 Gutierrez et al.
2004/0150502 A1 * 8/2004 Jacobson et al. ..... 336/200
2005/0059295 A1 3/2005 Chen et al.
2005/0088267 A1 4/2005 Watts
2005/0208914 A1 9/2005 Ogawa
2005/0248430 A1 11/2005 Dupraz et al.
2006/0176139 A1 8/2006 Pleskach et al.
2006/0290457 A1 12/2006 Lee et al.
2007/0001796 A1 1/2007 Waffenschmidt et al.
2007/0063807 A1 3/2007 Quilici
2007/0111598 A1 5/2007 Quilici
2007/0152651 A1 7/2007 Shiokawa et al.
2007/0210787 A1 9/2007 Ebenezer et al.
2007/0216510 A1 9/2007 Jeong et al.
2007/0290695 A1 12/2007 Mahon et al.
2008/0007249 A1 1/2008 Wilkerson et al.
2008/0036448 A1 2/2008 Kovach et al.
2008/0077336 A1 3/2008 Fernandes
2008/0079418 A1 4/2008 Rea et al.
2008/0096426 A1 4/2008 Chou Huang et al.
2008/0106253 A1 5/2008 Kojovic
2008/0111226 A1 5/2008 White et al.
2008/0186124 A1 8/2008 Schaffer et al.
2008/0211484 A1 9/2008 Howell et al.
2008/0233803 A1 9/2008 Renteria
2009/0002111 A1 1/2009 Harrison et al.
2009/0077791 A1 3/2009 Quilici
2009/0200682 A1 8/2009 Zhang
2009/0231769 A1 9/2009 Fischer et al.
2010/0013589 A1 1/2010 Schaffer et al.
2010/0259275 A1 10/2010 Grieshaber et al.
2010/0295646 A1 11/2010 Harrison et al.
2011/0014800 A1 1/2011 Cheng et al.
2011/0025304 A1 2/2011 Lint et al.

(56) References Cited

U.S. PATENT DOCUMENTS

| | | | |
|---|---|---|---|
| 2011/0025305 | A1 | 2/2011 | Lint et al. |
| 2011/0034081 | A1 | 2/2011 | Feldman et al. |
| 2011/0074397 | A1 | 3/2011 | Bulumulla et al. |
| 2011/0148561 | A1 | 6/2011 | Lint et al. |
| 2011/0291789 | A1 | 12/2011 | Dalmia et al. |
| 2012/0058676 | A1 | 3/2012 | Schaffer et al. |
| 2012/0175970 | A1 | 7/2012 | Jackman |
| 2013/0043967 | A1 | 2/2013 | Rouaud et al. |
| 2013/0063125 | A1 | 3/2013 | Chamarti et al. |
| 2013/0063129 | A1 | 3/2013 | Chamarti et al. |
| 2013/0063131 | A1 | 3/2013 | Chamarti et al. |
| 2013/0063161 | A1 | 3/2013 | Chamarti et al. |

FOREIGN PATENT DOCUMENTS

| | | |
|---|---|---|
| DE | 12 78 006 | 9/1968 |
| DE | 19712900 A1 | 11/1997 |
| EP | 0 555 994 | 8/1993 |
| EP | 0 708 459 | 4/1996 |
| EP | 0 756 298 | 1/1997 |
| JP | 2004186099 | 7/2004 |
| TW | 1279819 | 4/2007 |
| WO | WO 2010/065113 | 6/2010 |

OTHER PUBLICATIONS

Crotti G., et al., "Analysis of Rogowski Coil Behavior Under Non Ideal Measurement Conditions," IMEKO XIX World Congress, Fundamental and Applied Metrology, Sep. 6-11, 2009, Lisbon, Portugal, pp. 879-881.

<gs id="c4736986-e981-4d9e-b7b2-ee18fb1449d4" ginger_software_uiphraseguid="30afc511-2e18-4614-b403-6236b1fac7b4" class="GINGER_SOFTWARE_mark">IRIS</gs>, "Smart Grid Monitoring," Current Sensing For a Smarter Grid, Doc ref: 10068MAR10 V1.02, Sentec, http:/Jwww.sentec.co.uk/assets/library/documentliloriginA1/iris datasheet 1.02 v1<gs id="47d4e4e1-fb18-4913-a86e-d2a3fd4141bb" ginger_software_uiphraseguid="30afc511-2e18-4614-b403-6236b1fac7b4" class="GINGER_SOFTWARE_mark"> .</gs><gs id="d5dca3be-68c0-4c6f-a146-77e68f5f32c7" ginger_software_uiphraseguid="30afc511-2e18-4614-b403-6236b1fac7b4" class="GINGER_SOFTWARE_mark">pdf</gs>, (pp. 1-2).

Practical Aspects of Rogowski Coil Applications to Relaying by Kojovic, et A1. Sep. 2010.

* cited by examiner

INTEGRATED CONNECTOR MODULES FOR EXTENDING TRANSFORMER BANDWIDTH WITH MIXED-MODE COUPLING USING A SUBSTRATE INDUCTIVE DEVICE

PRIORITY AND RELATED APPLICATIONS

This application claims the benefit of priority to co-owned U.S. Provisional Patent Application Ser. No. 61/723,688 entitled "Substrate Inductive Device Methods and Apparatus" filed Nov. 7, 2012, the contents of which are incorporated herein by reference in its entirety.

This application is also related to co-owned and co-pending U.S. patent application Ser. No. 13/797,530 of the same title filed Mar. 12, 2013, which claims priority to U.S. Provisional Patent Application Ser. No. 61/723,688 of the same title filed Nov. 7, 2012, the contents of each of the foregoing being incorporated herein by reference in its entirety. This application is also related to co-owned and co-pending U.S. patent application Ser. No. 11/985,156 filed Nov. 13, 2007 and entitled "Wire-Less Inductive Devices and Methods", which claims priority to U.S. Provisional Patent Application Ser. No. 60/859,120 filed Nov. 14, 2006 of the same title, the contents of each of the foregoing being incorporated herein by reference in its entirety. This application is also related to co-owned U.S. Pat. No. 7,982,572 filed Jul. 15, 2009 and entitled "Substrate Inductive Devices and Methods", which claims priority to U.S. Provisional Patent Application Ser. No. 61/135,243, filed Jul. 17, 2008 of the same title, the contents of each of the foregoing being incorporated herein by reference in its entirety. Furthermore, this application is also related to co-owned and co-pending U.S. patent application Ser. No. 12/876,003 filed Sep. 3, 2010 and entitled "Substrate Inductive Devices and Methods", the contents of which are incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Technological Field

The present disclosure relates generally to circuit elements, and more particularly in one exemplary aspect to inductors or inductive devices, such as transformers, having various desirable electrical and/or mechanical properties, and methods of utilizing and manufacturing the same.

2. Description of Related Technology

A myriad of different configurations of inductors and inductive devices are known in the prior art. One common approach to the manufacture of efficient inductors and inductive devices is via the use of a magnetically permeable toroidal core. Toroidal cores are very efficient at maintaining the magnetic flux of an inductive device constrained within the core itself. Typically these cores (toroidal or not) are wound with one or more magnet wire windings thereby forming an inductor or an inductive device.

More recently, improved low cost and highly consistent inductive apparatus and methods for manufacturing, and utilizing, the same have been developed. One example of this is disclosed in co-owned and co-pending U.S. patent application Ser. No. 12/876,003 filed Sep. 3, 2010 and entitled "Substrate Inductive Devices and Methods", the contents of which are incorporated herein by reference in its entirety, which discloses a substrate based inductive device which utilizes inserted conductive pins in combination with plated substrates to replace traditional magnet wire windings disposed around a magnetically permeable core. In some variations this is accomplished without a header disposed between adjacent substrates while alternative variations utilize a header. In another variation, the substrate inductive devices are incorporated into integrated connector modules. However, as the electronics utilized within, for example, integrated connector modules has miniaturized, issues such as Conductive Anodic Filament (CAF) have become major barriers to implementing these substrate inductive devices. CAF occurs in substrates (such as printed circuit boards) when a copper filament foul's in the laminate dielectric material between two adjacent conductors or plated through-hole vias under an electrical bias. CAF can be a significant source of electrical failures in these substrate inductive devices.

Moreover, in signal transformer designs, the level of coupling between the primary side and the secondary side determines the bandwidth of the transformer. In transformer applications, the coupling can be: (1) capacitive (i.e., formed by the varying electric field between the two sides); and (2) inductive (i.e., formed by the varying magnetic field from the primary side of the windings). The bandwidth of the transformer is also greatly dependent on the matching of the impedance of the transformer to that of the line connected to the transformer. The impedance of a transformer is characterized by the ratio of its leakage (i.e., series) inductance and distributed (i.e., parallel) capacitance. Different manufacturing processes and designs may result in an imbalance in the matching ratio of the leakage inductance and the distributed capacitance. With large impedance mismatches, the bandwidth of the transformer can be greatly reduced. Furthermore, as the two above mentioned components that make up the impedance of a transformer are of a "distributed" type, they cannot easily be compensated by adding external components, such as via the addition of discrete capacitors and/or inductors.

Accordingly, despite the broad variety of substrate inductive device configurations, there is a salient need for substrate inductive devices that are much more resistant to failures (such as CAF) while simultaneously extending the bandwidth of the underlying device via, what is referred to herein as mixed mode coupling. Furthermore, such improved substrate inductive devices will be both: (1) low in cost to manufacture; and (2) offer improved electrical performance over prior art devices. Ideally such a solution would not only offer very low manufacturing cost and improved electrical performance for the inductor or inductive device, but also provide greater consistency between devices manufactured in mass production; i.e., by increasing consistency and reliability of performance by limiting opportunities for manufacturing errors of the device while minimizing failure modes such as CAF. Furthermore, methods and apparatus for extending the bandwidth of the transformer are also desired. Finally, methods and apparatus for incorporating these improved inductive devices into integrated connector modules are also needed.

SUMMARY

The aforementioned needs are satisfied herein by providing improved substrate inductive device apparatus and methods for manufacturing and using the same.

In a first aspect, a substrate inductive device is disclosed. In one embodiment, the substrate inductive device includes a plurality of substrates with at least one of the substrates including a via-in-via connection. The via-in-via connection is separated by a non-conductive material that is different than the underlying substrate material. A toroidal core is disposed within, or between, the plurality of substrates.

In a second aspect, a method of manufacturing the aforementioned substrate inductive devices is disclosed. In one embodiment, the method includes disposing a first conductive via in a substrate; disposing a non-conductive coating on the substrate; and disposing a second conductive via in the substrate such that the second conductive via is separated by the first conductive via by the non-conductive coating.

In a third aspect, methods of using the aforementioned substrate inductive devices are disclosed. In one embodiment, the aforementioned substrate inductive devices are used within an integrated connector module.

In a fourth aspect, a single-port connector which utilizes the aforementioned substrate inductive device is disclosed. In one embodiment, the single-port connector comprises an integrated connector module that includes a connector housing having a substrate inductive device disposed therein, the substrate inductive device further including a plurality of substrates, at least one of the substrates including a plurality of via-in-via connections, each via-in-via connection comprising an inner via and an outer via separated from the inner via by a non-conductive material; and a toroidal core disposed adjacent to the plurality of via-in-via connections.

In a fifth aspect, a multi-port connector which utilizes the aforementioned substrate inductive device is disclosed. In one embodiment, the multi-port connector comprises an integrated connector module having a plurality of substrate inductive devices having one or more via-in-via connections disposed therein.

In a sixth aspect, a method of manufacturing a single-port connector utilizing the aforementioned substrate inductive device is disclosed.

In a seventh aspect, a method of manufacturing a multi-port connector utilizing the aforementioned substrate inductive device is disclosed.

In a eighth aspect, networking equipment which utilizes the aforementioned multi-port connectors is disclosed.

In a ninth aspect, methods and apparatus for implementing mixed mode coupling are disclosed. In one embodiment, the method includes implementing one or more via-in-via connections in combination with one or more single via connections within an underlying substrate inductive device.

In a variant, increased interwinding and distributed capacitance is accomplished via the addition or expansion of plates associated with the underlying windings of the substrate inductive device.

BRIEF DESCRIPTION OF THE DRAWINGS

The features, objectives, and advantages of the disclosure will become more apparent from the detailed description set forth below when taken in conjunction with the drawings, wherein.

Reference is now made to the drawings wherein like numerals refer to like parts throughout.

DETAILED DESCRIPTION

Figure 1:
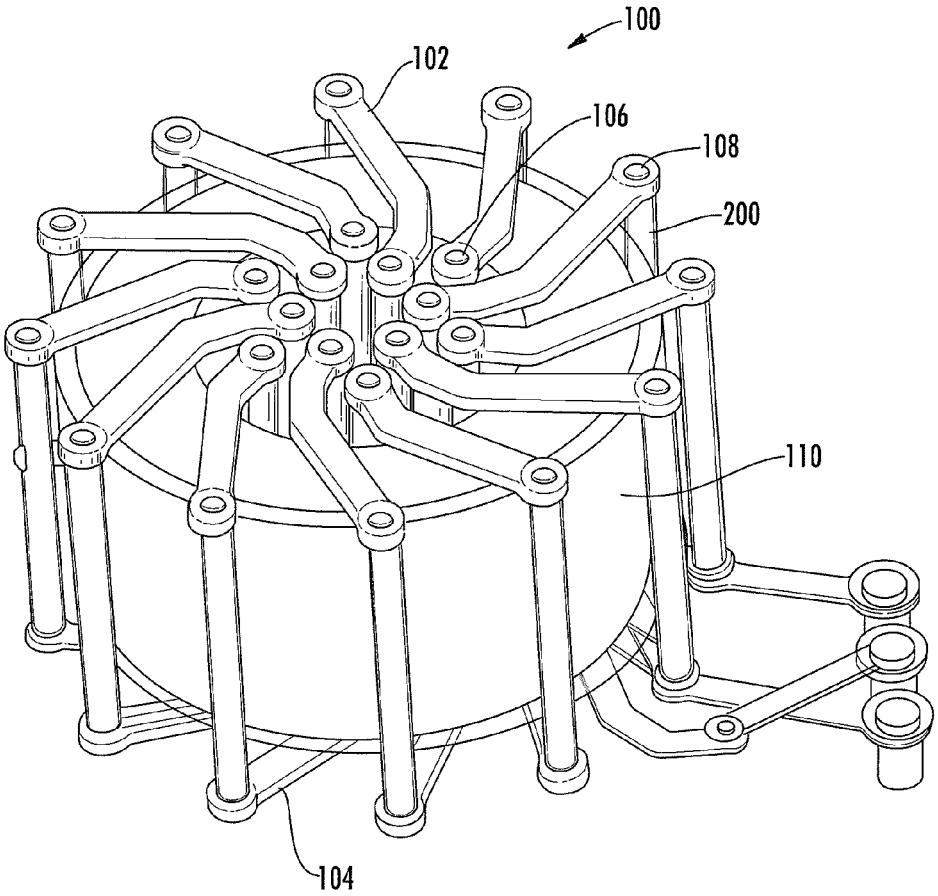
FIG. 1 is a perspective view of a substrate inductive device apparatus in accordance with the principles of the present disclosure.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

As used herein, the term "magnetically permeable" refers to any number of materials commonly used for forming inductive cores or similar components, including without limitation various formulations made from ferrite.

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Overview

The present disclosure provides, inter alia, improved low cost and highly consistent inductive apparatus and methods for manufacturing, and utilizing, the same.

In one exemplary embodiment, issues with so-called substrate inductive devices such as conductive anodic filament (CAF) that occurs within laminate structures (such as a fiberglass-based printed circuit board) under certain conditions are addressed. These conditions include high humidity, high bias voltage (i.e. a large voltage differential), high-moisture content, surface and resin ionic impurities, glass to resin bond weakness and exposure to high assembly temperatures that can occur, for example, during lead free solder bonding applications.

In one embodiment, via-in-via connections that join the upper traces with the lower traces on a printed circuit board that address CAF are disclosed. The via-in-via connections are present on both the outer diameter and inner diameter of a ferrite core. In an exemplary embodiment, three (3) substrates are utilized in such a substrate inductive device application. One substrate will be formed and hollowed out (such as via routing, etc.) in order to accommodate a ferrite core such as magnetically permeable toroid. The printed circuit board(s) utilized for these via-in-via connections comprises a multi-layer printed circuit board having multiple conductive layers. The multi-layer printed circuit board has, for example, four conductive layers including: (1) two outer layers which are in electrical communication with the inner vias of the via-in-via connection; and (2) two inner layers which are in electrical communication with the outer vias of the via-in-via connection. In exemplary embodiments of the present disclosure, a layer of non-conductive material (e.g. parylene) separates the inner and outer conductive vias and is ostensibly immune to the effects of CAF.

In an alternative embodiment, the use of mixed mode coupling is accomplished by, for example, the inclusion of a mixture of both: (1) via-in-via connections; and (2) single via connections. The mixed mode coupling techniques described herein are used to adjust the ratio between the leakage inductance and distributed capacitance of the underlying substrate inductive device (e.g., a transformer). By adjusting the ratio of leakage inductance and distributed capacitance, improved impedance matching is achieved resulting in, for example, increased operating bandwidth for the underlying substrate inductive device.

Methods of manufacturing and using the aforementioned substrate inductive devices are also disclosed.

Exemplary Embodiments

Detailed descriptions of the various embodiments and variants of the apparatus and methods of the present disclosure are now provided.

Substrate Inductive Device Apparatus—

It is well known in the electronics industry that conductive anodic filament (CAF) occurs within laminate structures (such as a fiberglass-based printed circuit board) under certain conditions. These conditions include high humidity, high bias voltage (i.e., a large voltage differential), high-moisture content, surface and resin ionic impurities, glass to resin bond weakness and exposure to high assembly temperatures that can occur, for example, during lead free solder bonding applications. Typically, CAF forms within the layers of the laminate, and at the surface from: (1) via-to-via; (2) via-to-trace; (3) trace-to-trace; and (4) layer-to-layer. Within the context of substrate inductive devices, via-to-via CAF formation is particularly problematic. Furthermore, within the context of substrate inductive devices, such as transformers, the relatively large bias voltages that can occur between the primary and secondary windings can be particularly problematic for CAF, especially during high-potential events.

FIG. 1 illustrates one such substrate inductive device 100 manufactured in accordance with the principles of the present disclosure with the underlying substrate removed from view for the purposes of clarity. The use of substrate inductive devices generally is well known and can be used in applications such as in integrated connector modules. The use of substrate inductive devices in integrated connector modules is described in co-owned and co-pending U.S. patent application Ser. No. 12/876,003 filed Sep. 3, 2010 and entitled "Substrate Inductive Devices and Methods", the contents of which are incorporated herein by reference in its entirety. FIG. 1 illustrates a transformer produced by the use of via-in-via connections 200 that join the upper traces 102 with the lower traces 104 on a printed circuit board (not shown). The via-in-via connections are present on both the outer diameter 108 and the inner diameter 106 of a ferrite core 110. In the exemplary embodiment illustrated, the ferrite core comprises a magnetically permeable toroid structure, although the principles discussed herein are by no means limited to toroid structures. In fact, any core structure such as shaped cores such as E, EC, EER, ER, EFD, ETD, U, UR, and planar E shaped cores, as well as ferrite pot cores including PQ, RS/DS, RM, and EP pot cores, etc., may be used consistent with the principles of the present disclosure.

Three (3) substrates are typically utilized in such a substrate inductive device application. One substrate will be formed and hollowed out (such as via routing, etc.) in order to accommodate a ferrite core in the center of the printed circuit board. In an exemplary embodiment, the ferrite core will be a toroid. Accordingly, the hollowed out portion of the substrate will be generally circular (i.e. toroidal) in shape to accommodate the toroidal core. Disposed adjacent to this inner printed circuit board will be a pair of outer printed circuit boards that serve as connections between the inner and outer vias seen on the inner printed circuit board. The height of this central printed circuit board will be generally larger than the toroidal core that it is to accommodate. More specifically, the central printed circuit board will be large enough to accommodate a buffer material between the disposed core and the adjacent outer substrate in order to accommodate the thermal expansion that occurs during, for example, soldering operations that would be typically seen during the processing of these substrate inductive devices. Disposed within this space used to accommodate this thermal expansion is a buffering material (such as a silicone type material) that enables the core to expand unimpeded and with minimal pressure so that the magnetic properties of the core are maintained.

Figure 2:
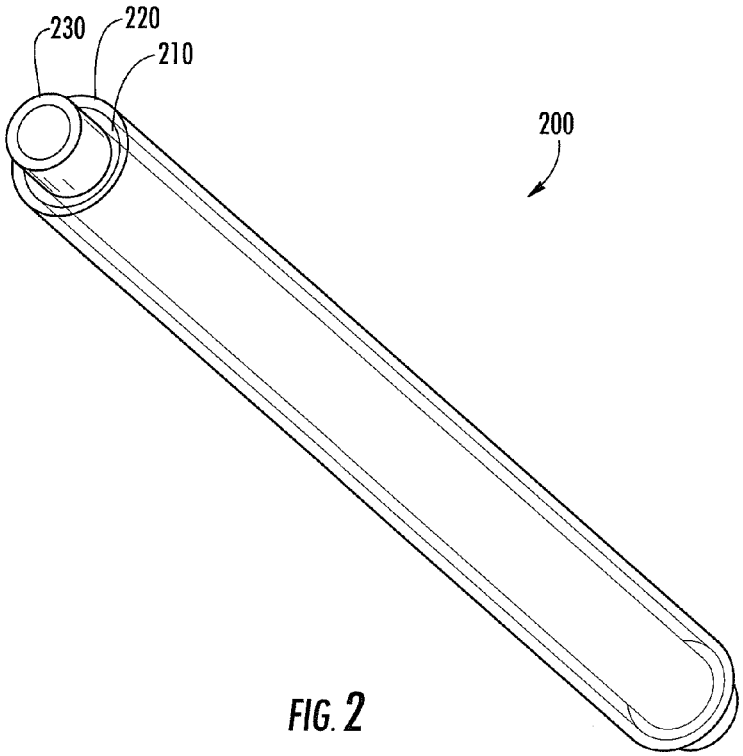
FIG. 2 is a perspective view of a via-in-via conductor apparatus in accordance with the principles of the present disclosure.

FIG. 2 illustrates the construction of an exemplary via-in-via connection 200 as described in various embodiments disclosed herein. The via-in-via connections are constructed of an inner conductive via 230 and an outer conductive via 210 that are separated from one another by an insulating material 220. In an exemplary embodiment, the insulating material is made from parylene, which is deposited onto the substrate via a vapor deposition process of the type well known in the electronic arts. In an exemplary embodiment, the parylene coating will have a thickness of approximately one (1) mil (one thousandths of an inch). Accordingly, by implementing an inner conductive via and an outer conductive via, two conductive paths (e.g., a primary winding and a secondary winding of a transformer) can be constructed. Furthermore, by constructing two windings at a single location (e.g. a primary and a secondary winding of a transformer) substantial space savings is achieved over prior art discrete windings. The aspect ratio of the structure illustrated is maintained low to achieve proper copper plating for the relatively small holes. The vias are constructed using a copper plating technology where air bubbles are used to agitate the plating tank so that the plating solution adequately enters each of the vias. A magnetic, or other method, is also used to ensure that the copper plating adequately plates inside of the relatively small vias.

Figure 3:
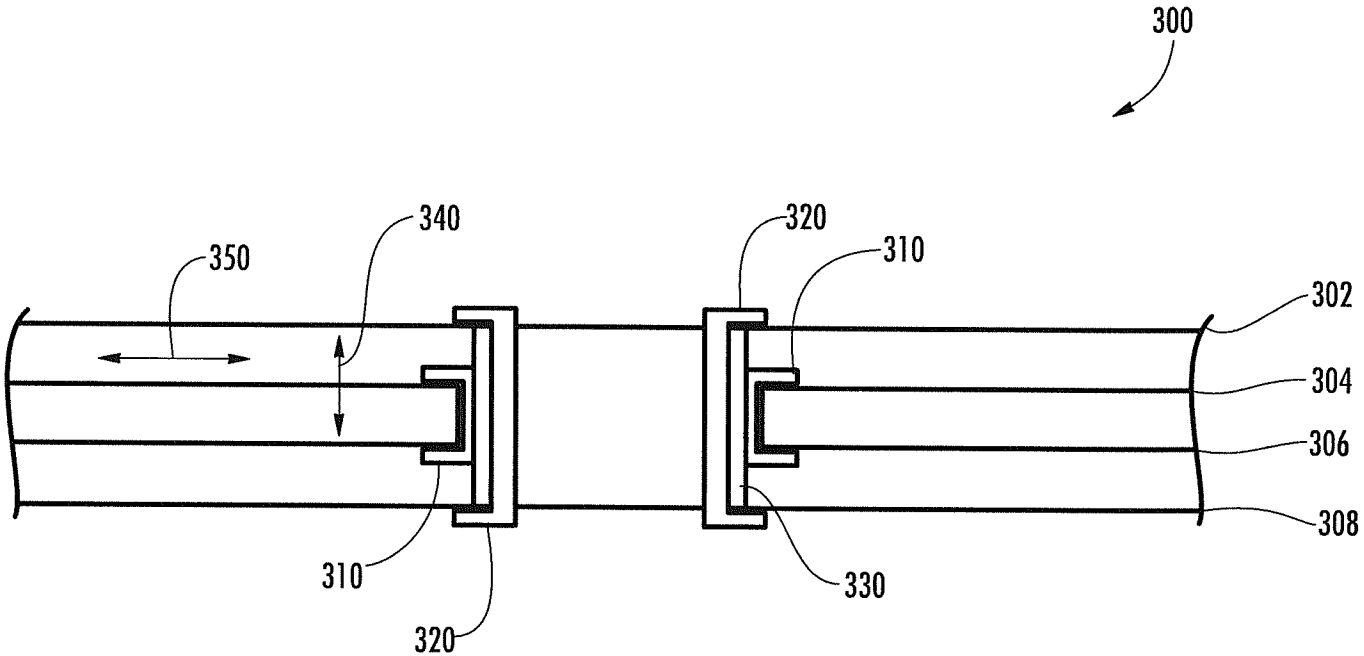
FIG. 3 is a cross-sectioned view of an exemplary via in via conductor apparatus disposed within a substrate in accordance with the principles of the present disclosure.

FIG. 3 illustrates the exemplary via-in-via connection shown in, for example, FIG. 2 embodied within a printed circuit board 300. The printed circuit board in FIG. 3 includes optimized via sizes, via locations and circuit layout in order to achieve acceptable CAF and bandwidth performance as discussed subsequently herein with respect to FIG. 5. The printed circuit board comprises a multi-layer printed circuit board having multiple conductive layers. In the embodiment illustrated, the multi-layer printed circuit board has four conductive layers including: (1) two outer layers 302 and 308 which are in electrical communication with the inner via 320 of the via-in-via connection; and (2) two inner layers 304 and 306 which are in electrical communication with the outer via 310 of the via-in-via connection. Herein lies a salient advantage of the via-in-via connection as it is used in practice with a multi-layer printed circuit board. As is well known, printed circuit boards are often constructed from a laminate material by curing, under pressure and temperature, layers of cloth or paper with a thermoset resin to form the underlying printed circuit board. Deposited within these layers of cloth or paper and a thermoset resin are the aforementioned copper layers. Conductive anodic filament (CAF) forms between, inter alia, conductive vias having a large voltage differential between them. In the context of printed circuit boards, CAF forms in a horizontal direction 350 as opposed to vertically 340 due in large part to the construction processes involved in the manufacture of printed circuit boards. Accordingly, in the context of an exemplary transformer application where the primary windings are disposed on one via 320 while the secondary windings are disposed on the other via 310, one would expect to see CAF formation along the horizontal plane 350. However, in the via-in-via construction of the illustrated embodiment, a layer of a non-conductive coating 330 (e.g. parylene) separates the inner 320 and outer 310 conductive vias which ostensibly is immune to the effects of CAF.

Furthermore, as the via-in-via connection illustrated in FIG. 2 is multiplied, such as would be the case in a substrate-based transformer, one can see that the effects of CAF can also be minimized by locating similarly arranged via-in-via connections adjacent to that shown in FIG. 3. In other words, by arranging the primary windings on the inner via 320 and the secondary windings on the outer via 310, adjacently disposed via-in-via connections would not be subject to high potential differentials that result in CAF formation. In other words, in the illustrated example, by including the primary windings on each of the inner vias which essentially would reside at the same voltage potential, one would not expect CAF formation between adjacent via-in-via connections. Alternatively, and just as effective, would be to include the secondary windings on the inner via 320 and the primary windings on the outer via 310. In such an implementation, no voltage potential would be seen between adjacent vias, resulting in little or no CAF formation between adjacent vias.

While disposing windings in the manner described above would be advantageous in many electronics applications, such a configuration is not without its drawbacks. For example, in many high-speed transformer applications (e.g., gigabit Ethernet) where balance between the primary and secondary windings is critical, one can see that by exclusively keeping the primary windings on one of the vias (e.g. on the outer vias) while disposing the secondary windings on the opposite one of the vias (e.g. on the inner vias) and imbalance will exist between the length of the path seen for the outer vias as opposed to the inner vias resulting in an imbalance between the primary and secondary windings. Accordingly, in applications in which balance is required between these alternate paths an alternative implementation is required.

Figure 4:
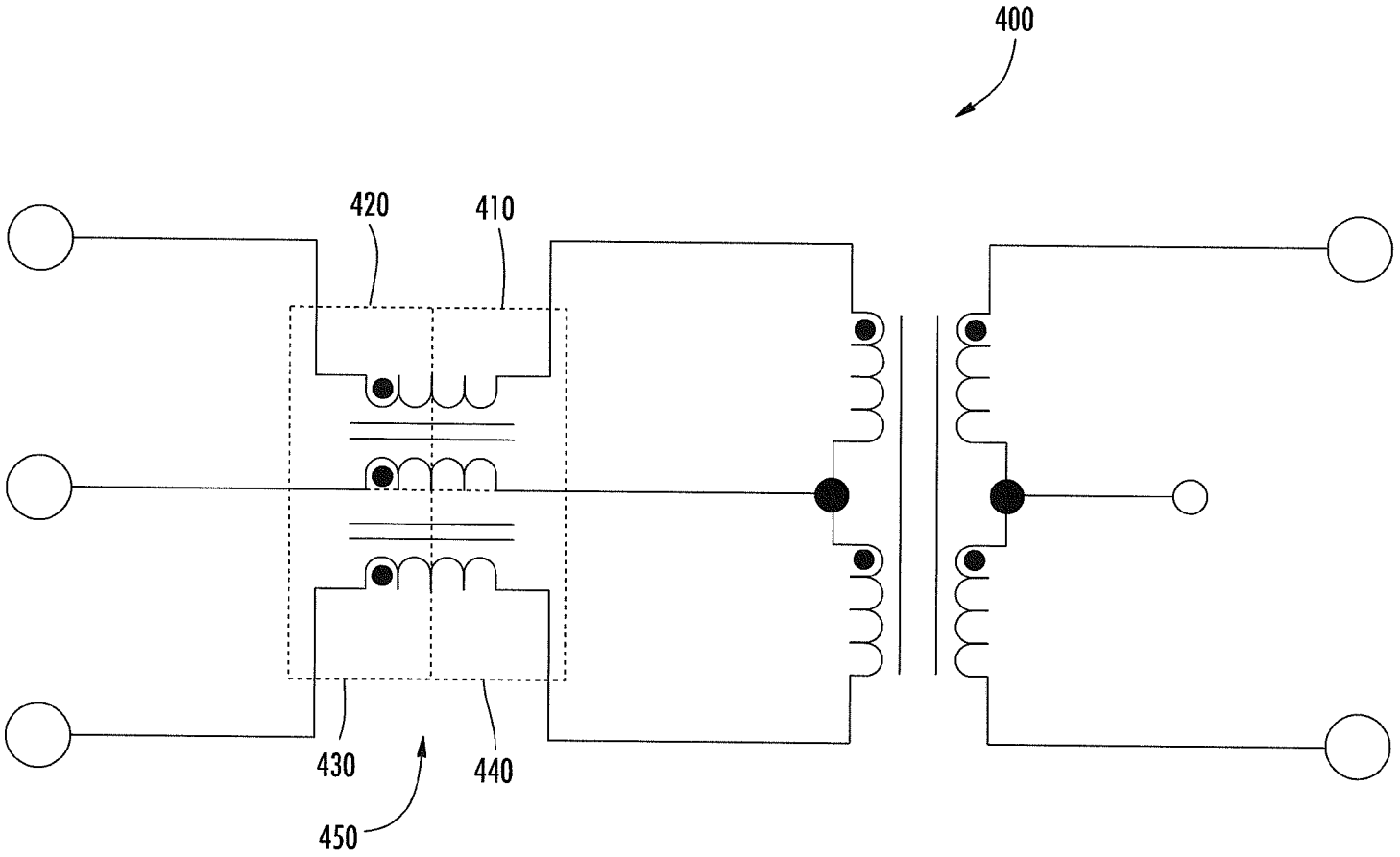
FIG. 4 is a schematic view of an exemplary electronic circuit in accordance with the principles of the present disclosure.

FIG. 4 illustrates such an alternative arrangement in which balance between the primary and secondary windings is achieved. FIG. 4 illustrates a typical transformer arrangement 400 seen in standard telecommunications applications (e.g., within an integrated connector module). Specifically, FIG. 4 illustrates a common mode choke 450 in which balance is achieved between the primary and secondary windings. The windings located in areas highlighted in 410 and 440 will be arranged in a first fashion, e.g. the primary windings 410 will be located on the outer vias while the secondary windings 440 will be located on the inner vias. The primary and secondary windings located in the areas highlighted in areas 420 and 430 will be reversed such that the primary windings 420 will be located on the inner vias while the secondary windings 430 will be located on the outer vias. In this fashion, perfect balance is achieved using the embodiment illustrated in FIG. 3 by alternating a given winding between the inner and outer vias so that the length of the pathways that make up the pathways in a transformer will be exactly equal resulting in balance between the primary and secondary windings.

Mixed Mode Coupling—

Referring back to FIG. 1, the level of coupling of the exemplary substrate inductive device 100 is considered to be relatively high, as the inner via signal path runs substantially parallel and adjacent to the outer via signal path throughout the entire substrate inductive device. As discussed previously herein, in signal transformer designs, the level of coupling between the primary side (e.g., outer vias) and the secondary side (e.g., the inner vias) ultimately determines the bandwidth of the underlying transformer. Coupling can be capacitive, formed by the varying electric field between the primary and secondary sides of the transformer, or inductive, formed by the varying magnetic field from the primary side. The bandwidth of the transformer is also greatly dependent upon the matching of the impedance of the transformer to that of the line to which the transformer is coupled. The impedance of the transformer is a function of its leakage (i.e., series) inductance and its distributed (i.e., parallel) capacitance and is governed by Equation (1) as set forth below.

$$\text{Impedance}=\text{Square Root}(L_{Leakage}/C_{Distributed}) \qquad \text{Equation (1)}$$

Hence, in certain applications the design illustrated in FIG. 1 may result in an imbalance in the matching ratio of leakage inductance and distributed capacitance, which may result in a large impedance mismatch between the transformer and the line, ultimately resulting in a significantly reduced bandwidth for the transformer. Moreover, as both leakage inductance and distributed capacitance are of a distributed type, they cannot easily be compensated for via the addition of external capacitors and inductors to the transformer design. Accordingly, in cases where the level of capacitive coupling is relatively high, the addition of some poorly inductively coupled turns may be added in order to help correct the inductive/capacitive ratio as set forth in Equation (1) above.

Figure 5:
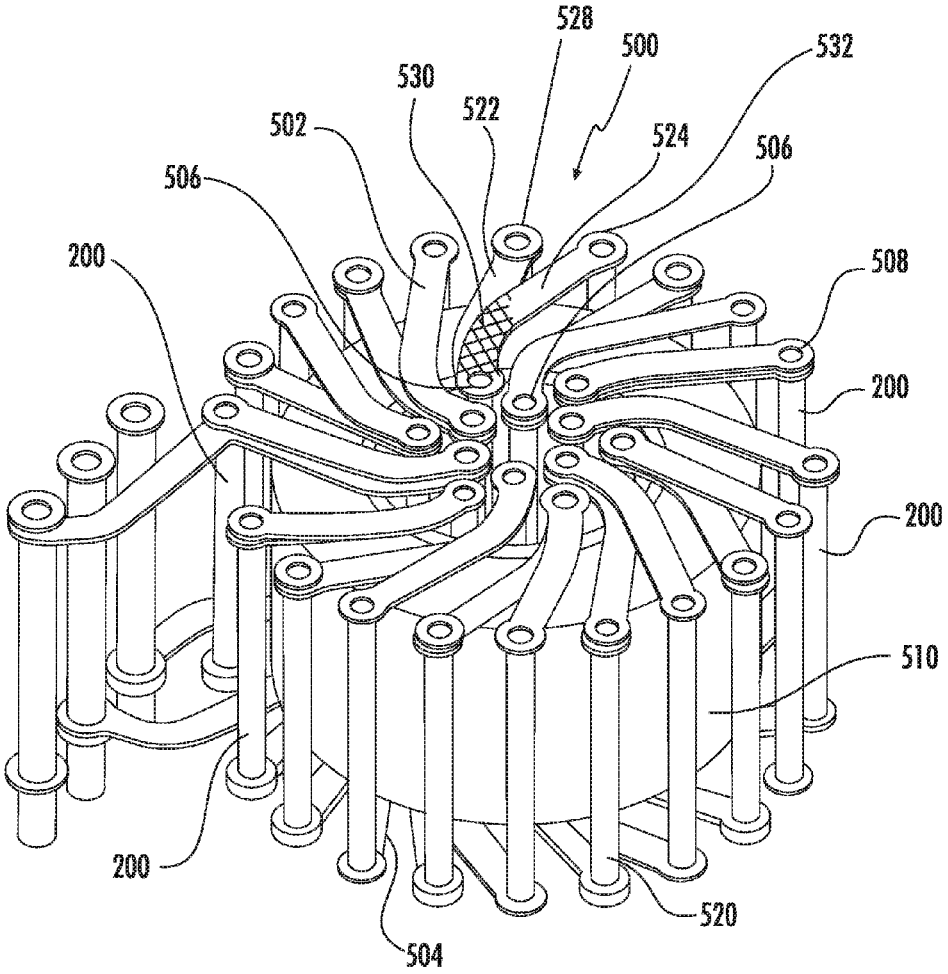
FIG. 5 is a perspective view of a substrate inductive device apparatus that utilizes mixed mode coupling techniques in accordance with the principles of the present disclosure.

Referring now to FIG. 5, an alternative arrangement of a substrate inductive device 500 in accordance with the principles of the present disclosure with the underlying substrate removed from view for the purposes of clarity is illustrated. Similar to that disclosed with respect to FIG. 1, the use of substrate inductive devices generally is well known and can be used in applications such as in integrated connector modules. However, unlike the embodiment disclosed with respect to FIG. 1, the substrate inductive device of FIG. 5 is configured to extend the operating bandwidth of the underlying device using mixed-mode coupling techniques as described in additional detail below. Specifically, FIG. 5 illustrates a transformer 500 produced through the use of via-in-via connections 200 that join upper traces 502 with lower traces 504 on a printed circuit board (not shown). The via-in-via connections are present on both the outer diameter 508 and inner diameter 506 of a ferrite core 510. However, unlike the embodiment illustrated in FIG. 1, there are only four (4) via-in-via connections 200 located on the outer diameter of the ferrite core. The remaining outer diameter vias 520 consist of single vias that join the upper traces 502 with the lower traces 504. Furthermore, due to the limited amount of space available on the inner diameter of the ferrite core 510 each of the vias resident within the inner diameter consist of via-in-via connections although it is appreciated that in embodiments in which there is more space available in the interior portion of the core, single vias could also be readily utilized.

Accordingly, in instances where the coupling within a given inductive structure is mostly capacitive (see e.g., FIG. 1), poorly inductively coupled turns (i.e., single vias) are added to the help correct the inductive/capacitive ratio in order to better match with the impedance of the line. Matching the impedance of the line with the substrate inductive device extends the bandwidth of the underlying inductive device and improves the return loss (i.e., the reflected signal due to impedance mismatch) for the inductive device. In the illustrated embodiment of FIG. 5, the adjacently disposed single via-only columns 520 are added in order to achieve additional poorly inductively coupled turns. Ideally, the inductive/capacitive ratio is the squared value of the line impedance as shown above with respect to Equation (1). For example, with a 100-Ohm line, the ideal leakage inductance to distributed capacitance ratio is equal to ten thousand (10,000), for which the square root value is equal to one hundred (100) to match the impedance of the line.

Conversely, in instances where the inductive coupling is rather poor (such as where the leakage inductance is higher than desired as a result of, for example, the inclusion of only single vias in a transformer design as opposed to via-in-via connections), an increased amount of distributed capacitance can be added in order to improve the impedance matching of the inductive device. This can be accomplished in a variety of different ways. For example, one way of increasing the distributed capacitance is via the addition of via-in-via connections to the underlying substrate inductive device design. The inclusion of via-in-via connections results in increased interwinding capacitance between the primary side and secondary side of the via-in-via connection. This resultant increased interwinding capacitance in turn results in increased distributed capacitance (i.e. an increased capacitance between adjacent turns of, for example, the primary winding).

Alternatively, one may increase the level of distributed capacitance of the substrate inductive device via expansion of the width of the upper 502 and/or lower traces 504. For example, by expanding the width of two (2) upper traces 522, 524, an increase in the amount of surface area 530 of the overlap between these adjacent traces is accomplished, thereby resulting in an increased interwinding capacitance and a resultant increase in the distributed capacitance for the substrate inductive device. Accordingly, this increased amount of distributed capacitance can be thought of as being accomplished via the addition of "plates", or otherwise flat conductor components along the turns of the inductive device, resulting in increased capacitance and ultimately more finely tuned impedance matching.

Finally, although the concept of increasing the level of mixed mode coupling has been discussed in the context of a ferrite core that comprises a toroid shaped core, it is appreciated that the principles discussed herein are by no means limited to toroid structures. In fact, virtually any core structure size and shape may be utilized consistent with the principles of the present disclosure. See also the discussion of alternative core arrangements discussed previously herein with respect to FIG. 1.

Methods of Manufacture—

Figure 6:
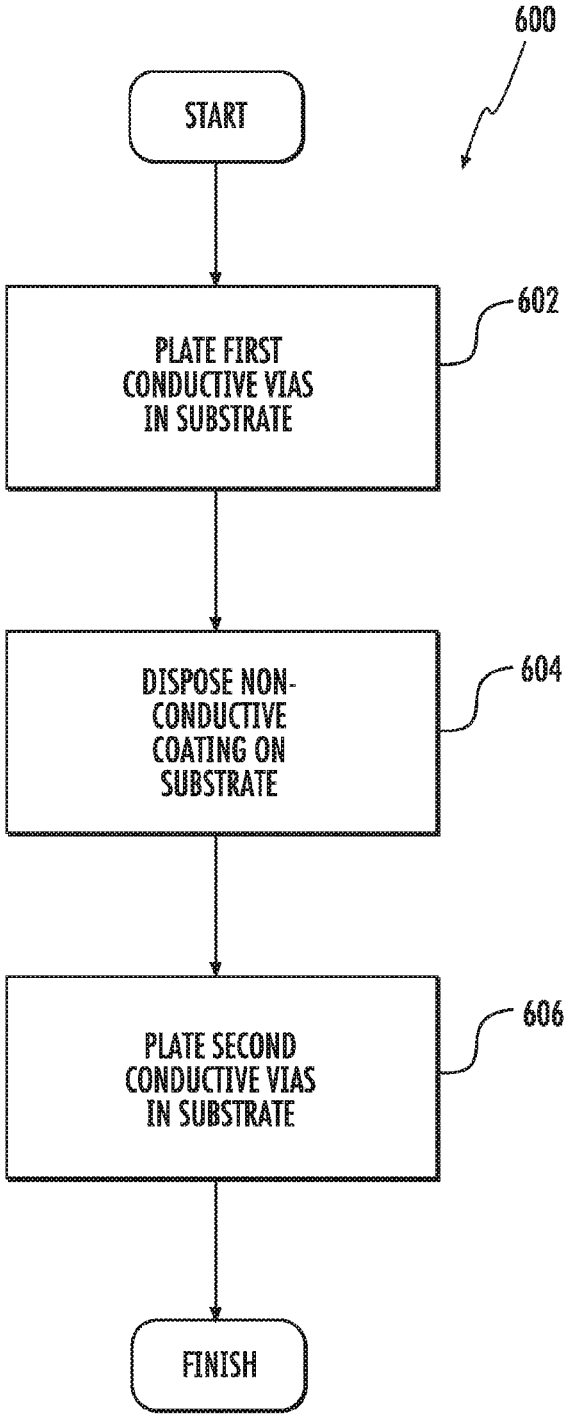
FIG. 6 is a logical flow diagram illustrating a first exemplary method for manufacturing the aforementioned substrate inductive devices in accordance with the principles of the present disclosure.

Referring now to FIG. 6, an exemplary method of manufacturing 600 the exemplary via-in-via substrate or mixed via-in-via substrate described above with respect to FIGS. 1-5 is shown and described in detail. At step 602, the first conductive vias are plated in the substrate. In an exemplary embodiment, the substrate comprises a four-layer printed circuit board. In other words, the substrate includes four (4) conductive layers disposed throughout three (3) non-conductive portions of the printed circuit board as shown in, for example, FIG. 3. The first conductive via (310, FIG. 3) plated will join the two inner conductive layers thereby forming the first via of the via-in-via connection.

At step 604, a non-conductive coating is disposed onto the substrate thereby covering the first via with a layer of insulating material. In an exemplary embodiment, the non-conductive coating comprises a parylene coating that is vapor deposited onto the substrate. The use of parylene coating is described in co-owned U.S. Pat. No. 8,234,778 filed on Jul. 18, 2011 and entitled "Substrate Inductive Devices and Methods", the contents of which are incorporated herein by reference in its entirety. Parylene offers significant advantages in that parylene is essentially immune to the effects of CAF. While the use of parylene is exemplary, other non-conductive coatings that are resistant to CAF may be readily substituted if desired.

At step 606, the second conductive via is plated on the substrate. For example, as shown in FIG. 3, the second conductive via will comprise the inner via 320 shown. The inner via will be separated from the outer via 310 by the deposited layer of a non-conductive coating (e.g. parylene). Accordingly, as CAF forms between areas having, for example, high voltage differentials, by placing the primary windings on either the inner or outer vias with the secondary windings on the opposite one of the vias, the use of parylene essentially prevents CAF formation in substrate inductive device applications.

It will be recognized that while certain aspects of the present disclosure are described in terms of specific design examples, these descriptions are only illustrative of the broader methods of the present disclosure, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure disclosed and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. An integrated connector module, comprising:

a connector housing having a plurality of substrate inductive devices disposed therein, at least one of the substrate inductive devices comprising:

a substrate comprising one or more via-in-via connections and one or more single via connections, each of the one or more via-in-via connections comprising an inner via and an outer via separated from the inner via by a non-conductive material; and a toroidal core disposed adjacent to the one or more via-in-via connections and the one or more single via connections;

wherein presence of both the one or more via-in-via connections and the one or more single via connections is configured to adjust a ratio of leakage inductance to distributed capacitance of the at least one of the substrate inductive devices.

2. The integrated connector module of claim 1, wherein the substrate comprises a multi-layer substrate comprising four (4) conductive layers comprising two (2) outer layers and two (2) inner layers;

wherein the inner via is coupled to the two (2) outer layers and the outer via is coupled to the two (2) inner layers.

3. The integrated connector module of claim 2, wherein the non-conductive material comprises a parylene coating.

4. The integrated connector module of claim 1, wherein the substrate comprises a thickness that is greater than a height of the toroidal core.

5. The integrated connector module of claim 4, further comprising an adjacent substrate and a buffer material, the buffer material being disposed between the toroidal core and the adjacent substrate in order to accommodate thermal expansion during soldering operations.

6. The integrated connector module of claim 5, wherein the one or more via-in-via connections and the one or more single via connections collectively form the windings for a transformer with approximately half of the inner vias comprising a primary winding and the other half of the inner vias comprising a secondary winding for the transformer.

7. The integrated connector module of claim 1, wherein the substrate comprising the one or more via-in-via connection comprises a plurality of via-in-via connections;

a first via-in-via connection comprises a portion of a primary winding for a transformer for the inner via connection; and a second via-in-via connection comprises a portion of a secondary winding for the transformer for the outer via connection.

8. The integrated connector module of claim 7, wherein the plurality of via-in-via connections collectively form the windings for a transformer with approximately half of the inner via connections comprising a primary winding and the other half of the inner via connections comprising a secondary winding for the transformer.

9. An integrated connector module, comprising:

a connector housing having a plurality of substrate inductive devices disposed therein, at least one of the substrate inductive devices comprising:

a substrate comprising a plurality of via-in-via connections and a plurality of single via connections, the plurality of via-in-via connections each comprising an inner via and an outer via separated from the inner via by a non-conductive material; and a toroidal core;

wherein the plurality of single via connections and some of the plurality of the via-in-via connections are disposed on an external periphery of the toroidal core, and other ones of the plurality of via-in-via connections are disposed on an internal periphery of the toroidal core; and wherein the plurality of via-in-via connections and the plurality of single via connections are configured to correct an inductive/capacitive ratio of the at least one of the substrate inductive devices.

10. The integrated connector module of claim 9, wherein the substrate that includes the plurality of via-in-via connections comprises a multi-layer substrate comprising four (4) conductive layers further comprising two (2) outer layers and two (2) inner layers;

wherein the inner via of a respective via-in-via connection is coupled to the two (2) outer layers and the outer via of the respective via-in-via connection is coupled to the two (2) inner layers.

11. The integrated connector module of claim 10, wherein the non-conductive material comprises a parylene coating.

12. The integrated connector module of claim 10, wherein the substrate comprises a thickness that is greater than a height of the toroidal core.

13. The integrated connector module of claim 9, wherein the external periphery of the toroidal core comprises fewer via-in-via connections than single via connections.

14. The integrated connector module of claim 9, wherein the internal periphery of the toroidal core further comprises one or more single via connections.

15. An integrated connector module, comprising:

a connector housing having a plurality of substrate inductive devices disposed therein, at least one of the substrate inductive devices comprising:

a substrate comprising a plurality of via-in-via connections and a plurality of single via connections, each of the via-in-via connections comprising an inner via and an outer via separated from the inner via by a non-conductive material;

a toroidal core disposed adjacent to the via-in-via connections and the single via connections;

a first trace which joins at least a portion of a first via-in-via connection disposed on an inner periphery of the toroidal core to a first one of the single via connections disposed on an outer periphery of the toroidal core; and a second trace which joins at least a portion of the first via-in-via connection disposed on the inner periphery of the toroidal core to a second one of the single via connections disposed on the outer periphery of the toroidal core, the first trace and the second trace being configured to at least partially overlap.

16. The integrated connector module of claim 15, wherein a width of the first trace and a width of the second trace are different.

17. The integrated connector module of claim 15, further comprising a third trace which joins at least a portion of a second via-in-via connection disposed on the inner periphery of the toroidal core to at least a portion of a third via-in-via connection disposed on the outer periphery of the toroidal core.

18. The integrated connector module of claim 17, further comprising a buffer material, the buffer material being disposed between the toroidal core and the substrate in order to accommodate thermal expansion during soldering operations.

19. The integrated connector module of claim 15, wherein an inner via of a respective via-in-via connection comprises a portion of a primary winding for a transformer; and wherein an outer via for the respective via-in-via connection comprises a portion of a secondary winding for the transformer.

20. The integrated connector module of claim 15, wherein an inner via of a respective via-in-via connection comprises a portion of a secondary winding for a transformer; and wherein an outer via for the respective via-in-via connection comprises a portion of a primary winding for the transformer.

* * * * *